US005441296A

United States Patent [19]

Phelipon et al.

[11] Patent Number: 5,441,296

[45] Date of Patent: Aug. 15, 1995

[54] SHOCK ABSORBING DEVICE FOR SKIS

[75] Inventors: Axel Phelipon, Annecy; Jacques Le Masson, Cran Gevrier, both of France

[73] Assignee: Salomon S.A., Metz Tessy, France

[21] Appl. No.: 73,512

[22] Filed: Jun. 9, 1993

[30] Foreign Application Priority Data

Jul. 31, 1992 [FR] France ..... 92 09734

[51] Int. Cl.[6] ..... A63C 5/075

[52] U.S. Cl. ..... 280/602; 280/607

[58] Field of Search ..... 280/602, 607, 609, 610, 280/11.14, 617, 633, 636

[56] References Cited

U.S. PATENT DOCUMENTS

| | | | |
|---|---|---|---|
| 2,258,046 | 10/1941 | Clement | 280/602 |
| 3,260,532 | 7/1966 | Heuvel . | |
| 3,398,968 | 8/1968 | Mutzhas . | |
| 3,937,481 | 2/1976 | Koleda . | |
| 4,577,886 | 3/1986 | Chernega | 280/602 |
| 4,865,345 | 9/1989 | Piegay | 280/602 |
| 4,896,895 | 1/1990 | Bettosini | 280/607 |
| 4,903,979 | 2/1990 | Dimier | 280/628 |
| 4,974,867 | 12/1990 | Rullier et al. | 280/607 |
| 5,251,923 | 10/1993 | Stepanek et al. | 280/602 |
| 5,269,555 | 12/1993 | Ruffinengo | 280/602 |
| 5,280,942 | 1/1994 | Ruffinengo | 280/602 |

FOREIGN PATENT DOCUMENTS

| | | | |
|---|---|---|---|
| 373786 | 2/1984 | Austria . | |
| 376571 | 12/1984 | Austria . | |
| 0793155 | 8/1968 | Canada | 280/602 |
| 0104185 | 3/1983 | European Pat. Off. . | |
| 0409749 | 7/1990 | European Pat. Off. . | |
| 0460574 | 12/1991 | European Pat. Off. . | |
| 0490043 | 6/1992 | European Pat. Off. | 280/602 |
| 0492658 | 7/1992 | European Pat. Off. . | |
| 0510308 | 10/1992 | European Pat. Off. | 280/607 |
| 0521272 | 1/1993 | European Pat. Off. . | |
| 0564767 | 10/1993 | European Pat. Off. . | |
| 1118857 | 6/1956 | France . | |
| 1269049 | 6/1961 | France . | |
| 1407710 | 6/1965 | France . | |
| 1433242 | 2/1966 | France . | |
| 1467141 | 1/1967 | France . | |
| 2433350 | 3/1980 | France . | |
| 2503569 | 10/1982 | France . | |
| 2575393 | 7/1986 | France . | |
| 2654636 | 5/1991 | France . | |
| 1578852 | 3/1971 | Germany . | |
| 1603002 | 8/1971 | Germany . | |
| 2135450 | 4/1972 | Germany . | |
| 2259375 | 6/1974 | Germany . | |
| 3315638 | 12/1983 | Germany | 280/602 |
| WO83/03360 | 10/1983 | WIPO . | |
| WO88/01189 | 2/1988 | WIPO . | |
| WO88/05324 | 7/1988 | WIPO . | |

*Primary Examiner*—Eric D. Culbreth
*Assistant Examiner*—Peter C. English
*Attorney, Agent, or Firm*—Sandler, Greenblum & Bernstein

[57] ABSTRACT

A ski equipped with at least one shock-absorption device adapted to absorb the vibrations of a ski having at least one flexion blade which includes a first portion fixed rigidly to the ski and a second portion connected to the ski in a longitudinally mobile manner by a shock-absorption arrangement of the viscous friction type.

50 Claims, 8 Drawing Sheets

SHOCK ABSORBING DEVICE FOR SKIS

BACKGROUND OF THE INVENTION

1. Field of the Invention

The present invention is related to a shock-absorption device for a ski, such as an alpine ski, a cross-country ski, a mono-ski or a snowboard. It is especially related to an improvement of such type of a device, and is also related to a ski equipped therewith.

2. Discussion of Background and Relevant Information

Different types of skis are known to be manufactured to have a more or less flexible structure. There are numerous variations which are constituted by a beam having an elongate shape, whose front end is curved upwardly to form a spatula, the rear end also being curved more slightly to constitute the heel.

Current skis generally have a composite structure in which different materials are combined such that each of them functions in an optimal manner, in light of the distribution of mechanical stresses during use of the ski. Thus, the structure generally comprises peripheral protection elements, internal resistance elements to resist flexional and torsional stresses and a core. These elements are assembled by adhesion or injection, the assembly generally being undertaken in a hot mold having the definitive shape of the ski, with a front portion substantially raised in a spatula, a rear portion slightly raised in the heel and a central arched portion.

Despite the concern of ski manufacturers to manufacture good quality skis, they have not, until now, found a high-performance ski satisfying all conditions of use.

Current skis have a certain number of disadvantages. In particular, they do not behave very well on snow during oscillations due to vibrations or flexions of the ski. Indeed, the persistent vibrations cause loss of adherence and therefore, bad performance from the ski. It is therefore very important to absorb the vibrations and, as such, various solutions have already been disclosed. For example, the solution proposed in the French Patent Publication Nos. 2,503,569 and 2,575,393 should be noted. However, these shock-absorption devices have only minor effects that are imperceptible to the skiers.

SUMMARY OF THE PRESENT INVENTION

It is an object of the present invention to overcome the various aforementioned disadvantages and to suggest a particularly simple solution which is also efficient and reliable as regards the problems of absorption of vibrations.

Thus, the ski according to the invention comprises at least one shock absorption device adapted to damp vibrations, which is constituted by at least one flexion blade which comprises a first portion fixed rigidly to the ski and a second portion connected to the ski in a longitudinally mobile manner, by shock-absorption means of the viscous friction type. By viscous friction, the friction that occurs during a relative displacement of the surface of the blade with respect to the surface in contact with a viscous fluid, or a viscoelastic material, is intended.

According to a complementary characteristic, the second portion is spaced longitudinally from the first portion.

According to another characteristic, the shock-absorption means of the viscous friction type are constituted by at least one layer of viscous material, such as mineral or organic grease or putty.

In a preferred advantageous arrangement, the second portion of the flexion blade is engaged in the sliding housing of a bush affixed to the ski, said sliding housing comprising a viscous material. The bush is a U-shaped stirrup, for example, whose sliding housing is open downwardly. According to another arrangement, the bush comprises peripheral walls and is an impervious casing. The impermeability enables a constant shock-absorption value to be guaranteed over time (as long as it is used uniformly).

In another embodiment of the invention, the bush comprises a pressure element, adjustable or not, of the pneumatic, hydraulic or elastic type, such as a spring that acts on the blade. An adjustable pressure element has the advantage of being able to increase or decrease the shock-absorption value according to use to which the ski is subjected, and according to atmospheric conditions and temperatures. In addition, it enables the correct adjustment of the same value for each ski constituting the pair.

According to preferred embodiments, the flexion blade is a blade which is either metallic or made of aluminum, steel or a composite material.

The invention is also related to the device adapted to equip the ski and which comprises a flexion blade and a bush, comprising a viscous material such as grease.

According to one of the embodiments, the flexion blade is located and fixed at the upper surface of the ski, whereas according to another embodiment, it is located in the structure of the ski.

The blade can extend at the front of the ski between the front contact point and the assembly zone of the bindings, but it can also extend much further towards the rear. The bush being fixed on the ski at the front of the assembly zone of the bindings, or extending along the entire assembly zone of the bindings, and acting a is their support.

Naturally, the flexible blade can extend to the rear of the ski between the rear contact point and the assembly zone of the bindings, or extend much further frontwardly.

It is understood that the ski according to invention can have several shock-absorption devices.

BRIEF DESCRIPTION OF THE DRAWINGS

Other advantages and characteristics of the invention will become clearer upon reading the description that follows with reference to the annexed drawings which are only provided as non-limiting examples.

FIG. 1 is a side elevation view.

FIG. 2 is a top plan view.

FIG. 3 is a transverse section along 3—3 of FIG. 1, on a larger scale.

FIG. 4 is a partial longitudinal section along line 4—4 of FIG. 2 on a larger scale.

FIGS. 5 and 6 show, in side elevation views, how the device functions, FIGS. *5a* and *6a* being partial representations on a larger scale of FIGS. 5 and 6.

DETAILED DESCRIPTION OF THE PREFERRED EMBODIMENTS

Figure 1:
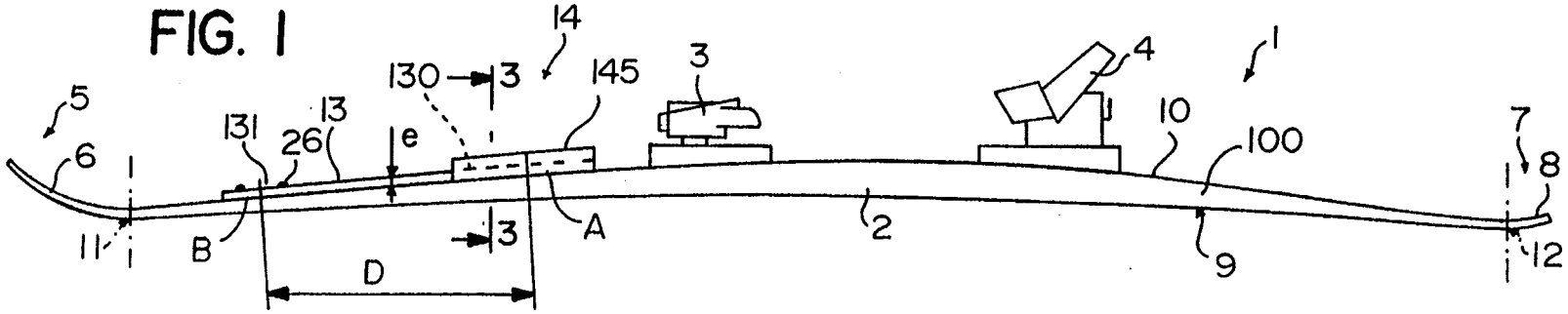
FIGS. 1–6 represent a first embodiment.
Figure 2:
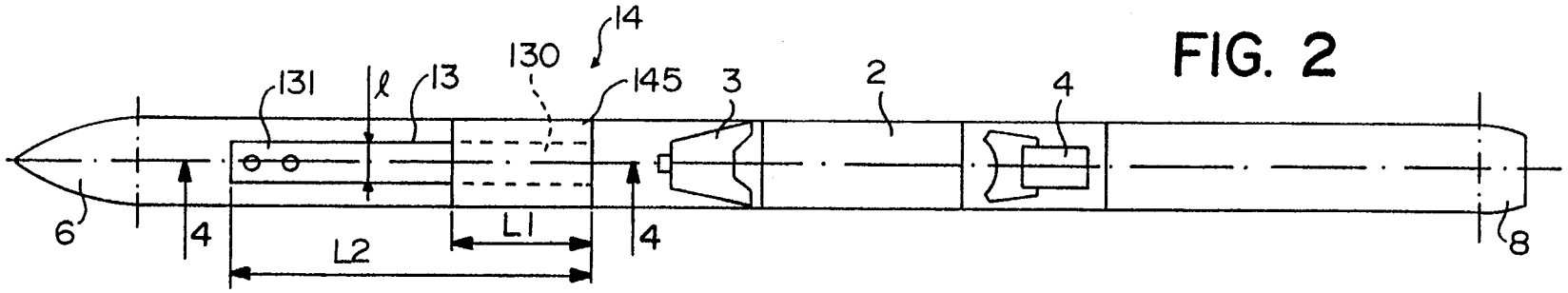
Figure 4:
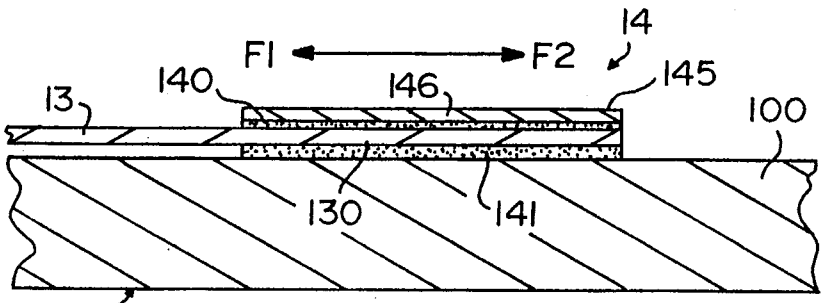

Ski 1, comprising the device, is constituted by an elongate beam 100, having its own distribution of thickness, of width, and therefore its own stiffness. It comprises a central portion 2, also called the assembly zone of bindings 3,4, adapted to retain the boot on the ski, the front binding 3 being commonly known as an abutment, whereas the rear binding 4 is generally known as the heel attachment. The front end 5 of ski 1 is raised to form the spatula 6, whereas the rear end 7 is also raised to form the heel 8 of the ski. The beam also comprises a lower sliding surface 9 and an upper surface 10. The contact of the lower surface 9 with the snow occurs between the front contact point 11 and the rear contact point 12 corresponding to the areas at which said lower surface starts to get raised.

FIGS. 1–6 represent a first embodiment according to which the shock-absorption device as per the invention, is constituted by a flexion blade 13 located at the front on the upper surface 10 of ski 1. According to the invention, the flexion blade is fixed to the ski by a first portion constituted by the front end 131 of the blade, whereas, the blade is connected to it by a second portion, by shock absorption means 14, of the viscous friction type. The binding of the first portion 131 of the blade on the ski is a fixed rigid connection obtained, for example, by screws 26, by adhesion or by welding. It must be specified that the blade is flexible in flexion and does not generate additional static stiffness (or stiffness which is negligible with respect to the remainder of the ski). According to this embodiment, the second portion of blade 13 is constituted by the rear end 130, longitudinally mobile with respect to the ski, and which is connected to it by friction means 14 of the viscous type. The friction means 14 of the viscous type are a mobile viscous connection with the ski, located on the top of the ski such that the rear portion 130 connected to the ski in a mobile viscous manner is spaced longitudinally at a distance D from the front portion 131 fixed rigidly to the ski. The distance D is to be considered to be the distance between two points A and B which are, respectively, the middle points of the zone retained by the bush and of the zone fixed to the ski.

To this end, the friction and absorption means 14 are constituted by a bush or stirrup 145 fixed to the ski by screws 15 comprising a sliding housing 144 for the flexion blade, said housing filled with a viscous material such as grease of the silicone type, putty or other. The bush being constituted by a U-shaped stirrup, fixed to the ski and comprising an upper wall 146 and two lateral walls 148, 149. Thus, the sliding portion 130 of flexion blade 13 is completely surrounded by a layer of grease forming a viscous film in the bush: an upper layer 140, a lower layer 141 and two lateral layers 142, 143. The bush 145 is generally U-shaped open downwardly, forming the sliding housing 144 and fixed to the ski by screws 15 in front of the assembly zone of the bindings, and especially of the front binding 3, whereas the front portion 131 of the flexion blade 13 is fixed to the ski at the front end thereof and for example, at the rear of its front contact zone 11. The rear end 130 of the flexion blade can thus be displaced longitudinally within the bush along directions F1 and F2 (see FIG. 4) with respect to body 2 of the ski, as is represented in FIGS. 5, 5*a*, 6 and 6*a*.

Figure 5:
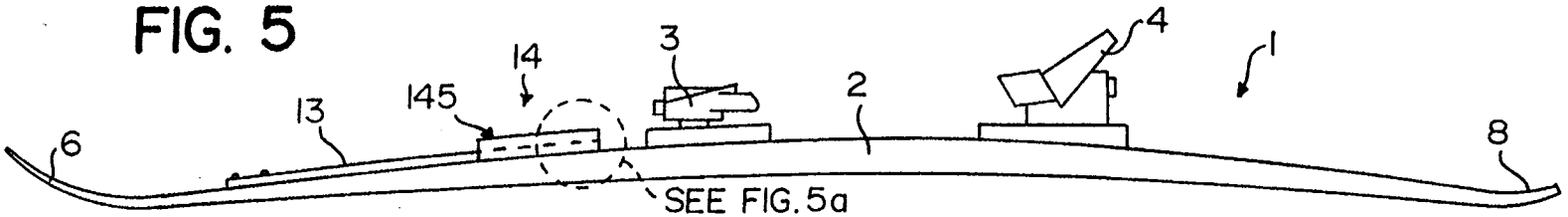
Figure 5A:
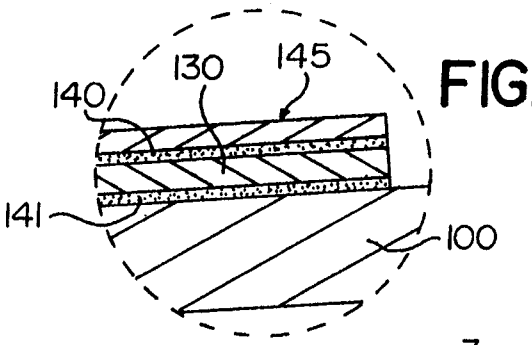
Figure 6:
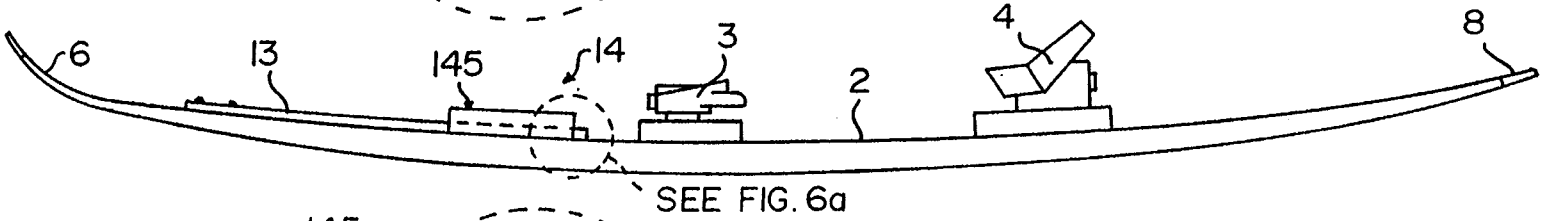
Figure 6A:
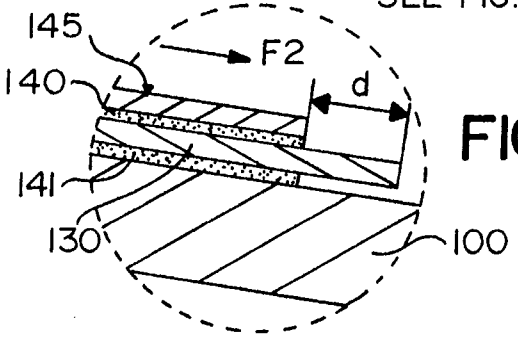

FIGS. 5, 5*a*, 6 and 6*a* schematically represent the shock-absorption function. FIG. 5 shows the ski in the resting position and FIG. 6, during flexion. During flexion, it must be noted that there is a relative rearward displacement of the rear end 130 of the blade with respect to the friction means 14. According to the diagrammatic representation, the rear end is displaced rearwardly along F2 over a relative distance d and such displacement is braked by the layers of viscous material (140, 141, 142, 143). The braking, and, therefore, the shock-absorption occurs naturally, also in the relative inverse displacements, i.e., along direction F1, in the return movements to the initial position and along a direction counter to the arrow.

It must be noted that the flexion blade 13 is made of aluminum or steel, or a composite material having a width l comprised between 10 and 45 millimeters and a thickness e comprised between 0.5 and 8 millimeters. It is fixed onto the ski between the zone 11 of the front contact point and binding 3, whereas the length L1 of the bush is comprised between 2% and 100% of the length L2 of the blade. In addition, the thickness of the viscous film can be comprised between 0.1 and 1 millimeter.

Figure 7:
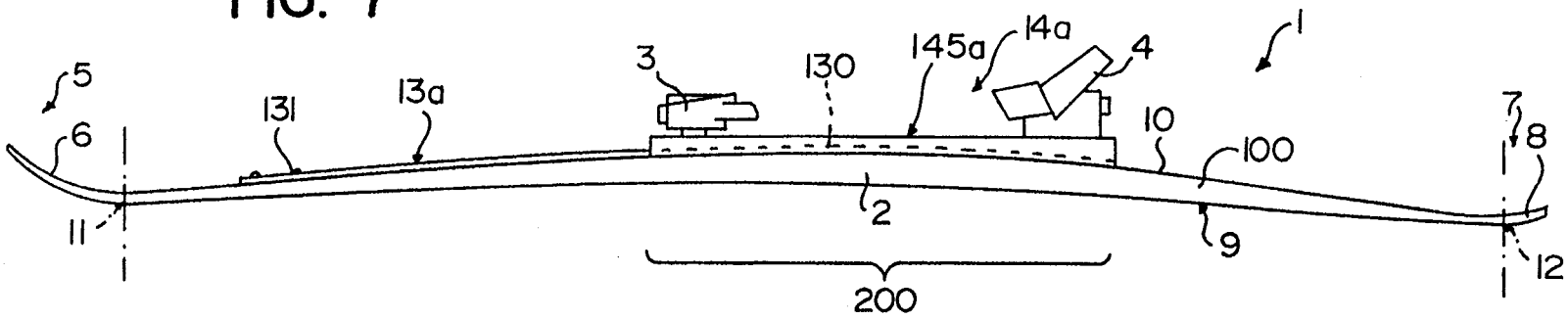
FIGS. 7, 8 and 9 are views similar to FIG. 1, showing three other embodiments.

It is to be understood that the flexion blade can be more or less long and, for example, can be represented as shown in FIG. 7. According to this variation, blade 13*a* extends rearwardly, much further than previously, to be retained by friction means 14*a* constituted by a bush 145*a* extending along the entire assembly zone 200 of the two bindings 3,4. Naturally, said bush 145*a* is of the type illustrated in the first embodiment. However, bush 145*a* is used, in this embodiment, to support bindings 3,4 to which they are fixed, instead of being fixed on the upper surface 10 of portion 100 of the actual ski.

Figure 8:
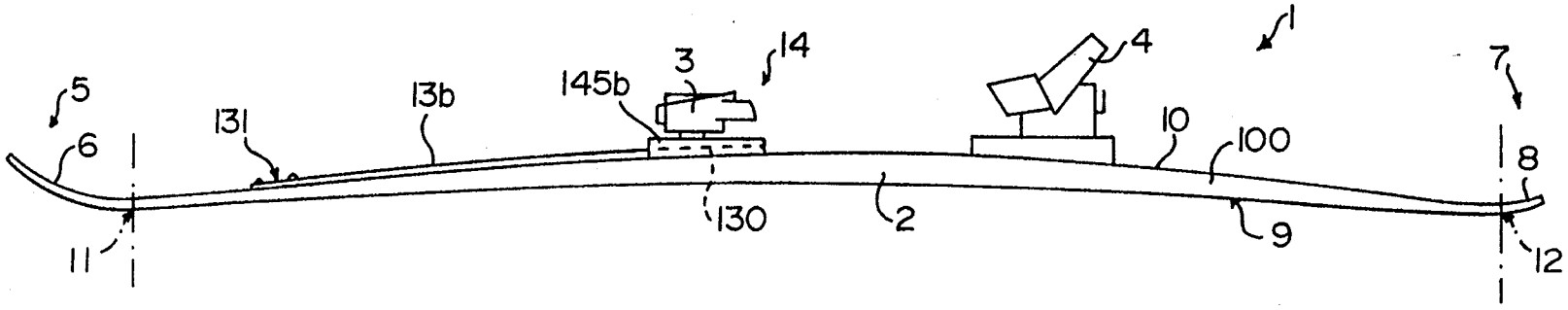

Naturally, it is not necessary that the flexion blade 13 extend beyond the level of the front binding 3. Indeed, the device can be such as illustrated in FIG. 8 which represents another variation, according to which the retention means of blade 13*b* and shock-absorption are constituted by a bush 145*b* which only extends locally beneath the front binding 3.

Figure 9:
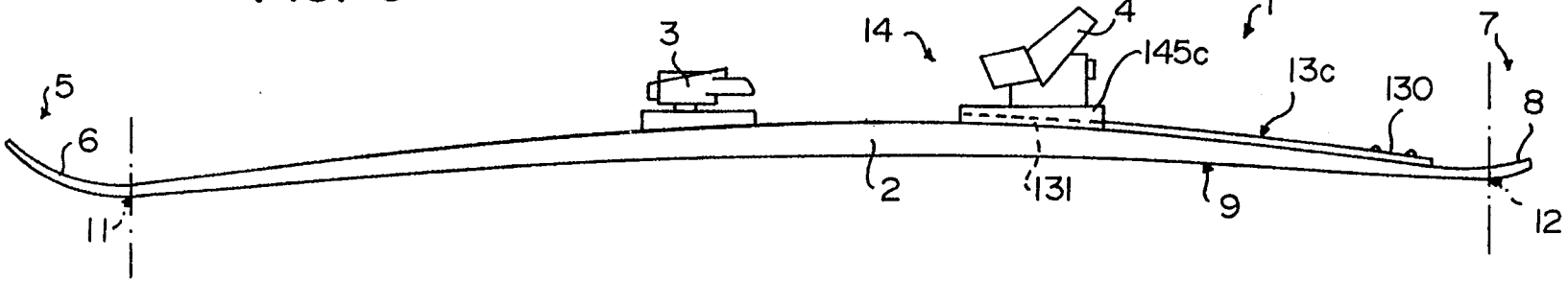

Naturally, the shock-absorption device according to the invention, such as the one described previously, can be located at the rear of the ski as can be seen in FIG. 9. Thus, the rear end 130 of blade 13*c* is fixed at the rear of the ski and extends frontwardly in such a way that its front end 131 is connected to the ski in a longitudinally mobile manner by friction means 14. The friction means can be constituted by a bush 145*c* identical to bush 145, but located beneath rear binding 4, and acting as a support for it. Naturally, blade 13*c* can extend frontwardly beyond the rear binding 4 and beneath front binding 3.

Figure 10:
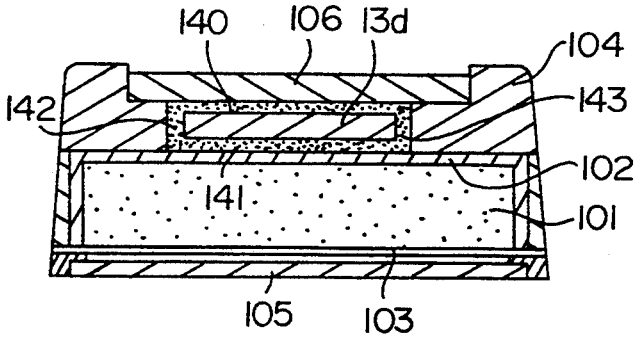
FIG. 10 is a transverse sectional view of a ski whose shock-absorption device is embedded.

In the different embodiments suggested in FIGS. 1–9, the shock-absorption device is located outside the actual structure of the ski. But, it would not be beyond the scope of the invention if such device were embedded in the ski, as is represented schematically in FIG. 10.

Skis are most often constituted by a core 101 covered by one or several layers of upper 102 and lower 103 reinforcements. The top of the ski is generally covered by a protection layer 104, whereas the bottom comprises a sliding layer made of polyethylene 105. Thus, in the embodiment of FIG. 10, the shock-absorption device is embedded in the ski and an upper plate 106 creates the necessary sliding housing and ensures the impermeability of the device by insulating it completely from external factors.

It is to be understood that the flexion blade, which in the embodiments suggested, has a rectangular section, can be of any type. It can, for example, be constituted by a cylindrical rod. In particular, it can be provided that the blade be designed in such a way that it is predisposed to downward buckling, rather than upward buckling, so as to avoid any blockage of the device. Various solutions can be envisioned by one skilled in the art and consist of, for instance, lowering the position of the neutral fiber of the blade by providing it with an Omega shape in its central portion for example (not represented).

Figure 3:
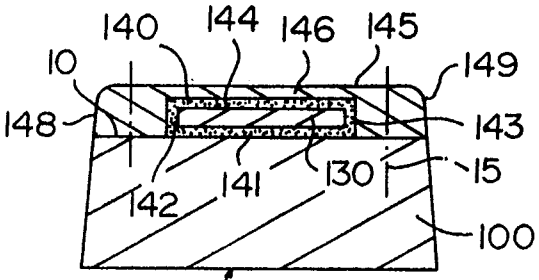
Figure 11:
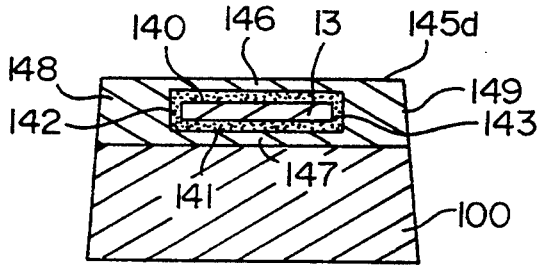
FIG. 11 is a view similar to FIG. 3, illustrating a variation.

FIG. 11 is a view similar to FIG. 3, illustrating a variation according to which bush 145*d* comprises a lower wall 147 parallel to the upper Wall 146.

Figure 12:
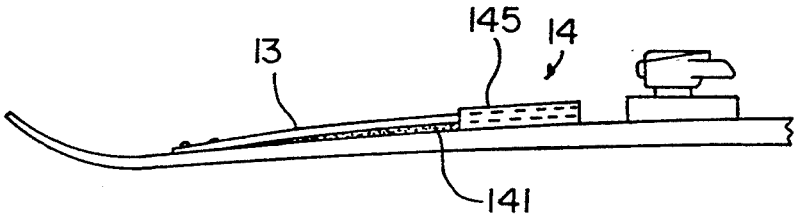
FIG. 12 is a partial side elevation view showing a variation of the embodiment.

FIG. 12 illustrates, in a side elevation view, another variation according to which the lower layer 141 of the viscous material extends beyond the bush and beneath the entirety of the blade.

It is to be understood that the bush can be fixed to the ski by means other than screws. Indeed, it can also be adhesively secured or welded. It must be noted that the ski of the invention can have several shock-absorption devices, as for example, two devices: one located at the front, as illustrated in FIGS. 1 or 8, and the other at the rear, as illustrated in FIG. 9.

Figure 13:
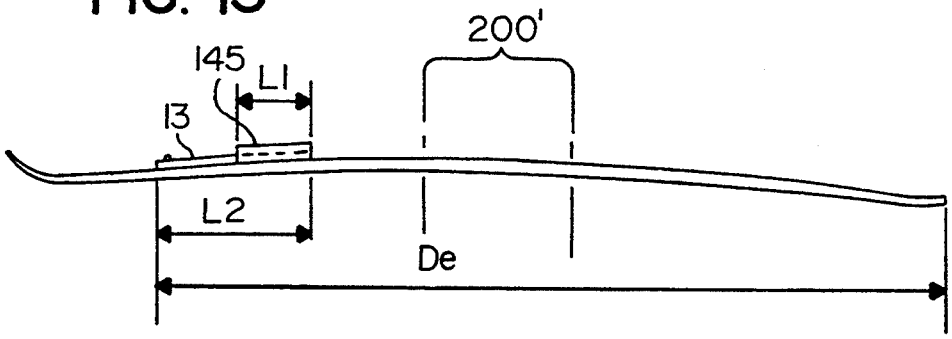
FIGS. 13–15 are side elevation views illustrating three shock-absorption device types that were tested.
Figure 14:
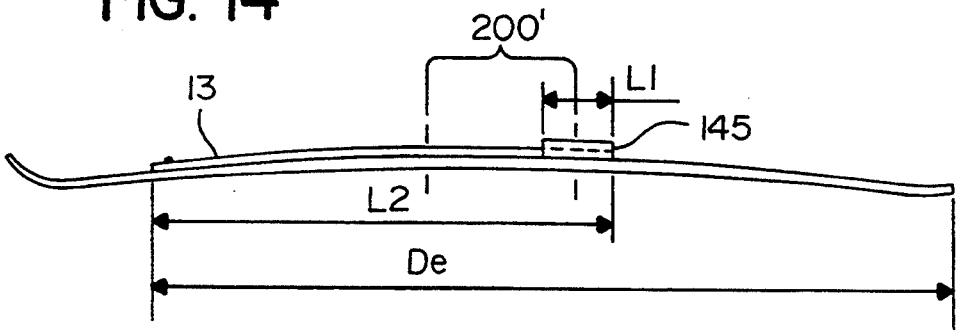

As an example, shock-absorption tests were conducted on a ski of 2010 millimeters with in a first example (FIG. 13), a flexion blade 13 having a small length L2 equal to 230 millimeters, the bush 145 having a length L1 of approximately 100 millimeters and a width of 29 millimeters. The contact surface between the two sides of the blade and the bush constituting the active viscous friction surface is about $2\times(100\times29)$ or 5800 millimeters$^2$ approximately (leaving out the friction at the level at the edges of the blade). The fluid used has a viscosity of approximately 400 poise. The distance De of the zone fixed at the rear of the ski is 1660 millimeters. The shock-absorption test was conducted on a ski, flanged at its center along a distance of 300 millimeters; the spatula is loaded with a mass of 20 kilograms by weight, and released suddenly in order to measure the absorption of the vibrations created. The shock absorption value obtained in this case was of the order of 3.2%.

In a second case (FIG. 4), the parameter that was varied with respect to the preceding case was the length of blade L2 which is equal to 1060 millimeters instead of 230 millimeters. The shock-absorption surface remains identical, that is 5,800 millimeters$^2$. In these conditions, the shock-absorption value rises to the order of 6.7%.

The comparison of the shock-absorption values of these two initial cases demonstrates, therefore, the importance of the length of the blade on the efficiency of the entire shock-absorption device.

Figure 15:
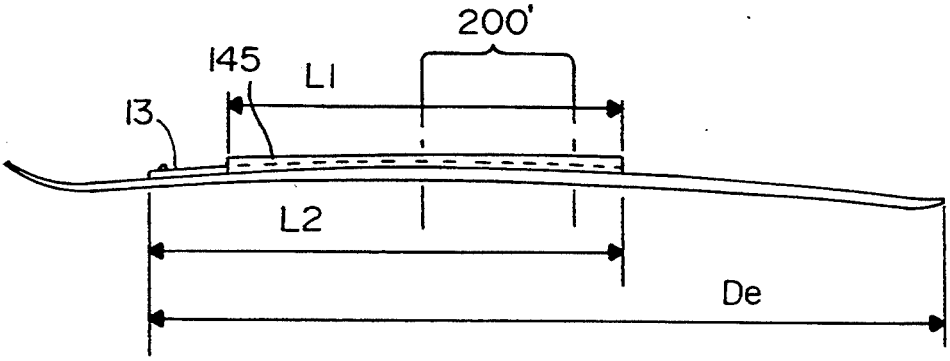

In a last example (FIG. 15), length L1 of bush 145 is increased with respect to the preceding case, so as to increase the active shock-absorption surface. Length L1 is equal to 930 millimeters instead of 100 millimeters. The shock-absorption surface is equal to approximately $2\times(930\times29)=53{,}940$ millimeters$^2$. All of the other parameters are maintained constant with respect to the previous cases. The shock-absorption value obtained is 8.2%. It should be noted that the active contact surface also substantially affects the shock-absorption value obtained.

The active surface can be reduced, for identical shock-absorption values, if one provides for the application of a means exerting pressure on the blade at the level of the bush, as will be explained hereafter.

Generally speaking, length L2 of the blade, can be comprised between 150 and 1,800 millimeters, whereas the bush has a shock-absorption surface greater than 170 millimeters$^2$.

The viscous material can be of any type, and, for example, have a viscosity comprised between 20 and 1,500 poise at 40° C. Advantageously, the viscosity is approximately 400 poise. The material can be a mineral or organic grease. One can also use a viscoelastic material such as a putty.

Figure 16:
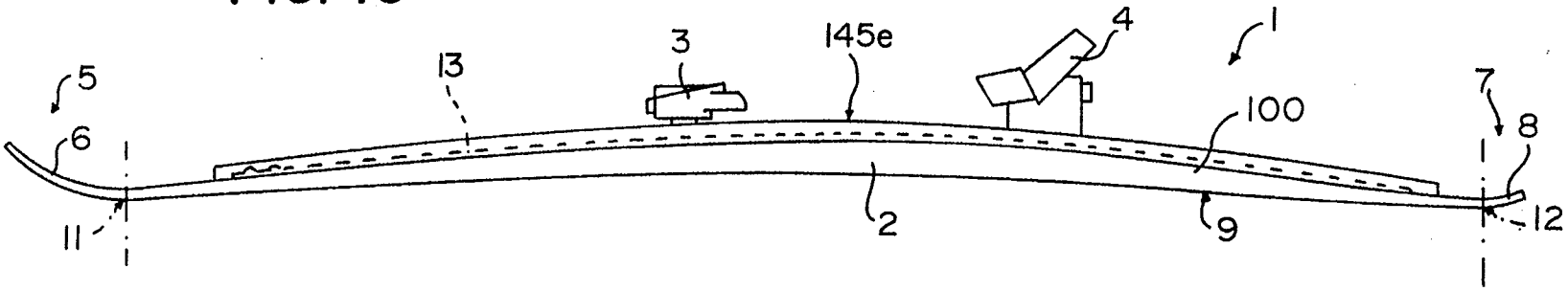
FIG. 16 is a view similar to FIG. 1, illustrating a variation.

FIG. 16 illustrates another variation according to which the bush 145*e* covers the flexion blade 13 along its entire length.

Figure 17:
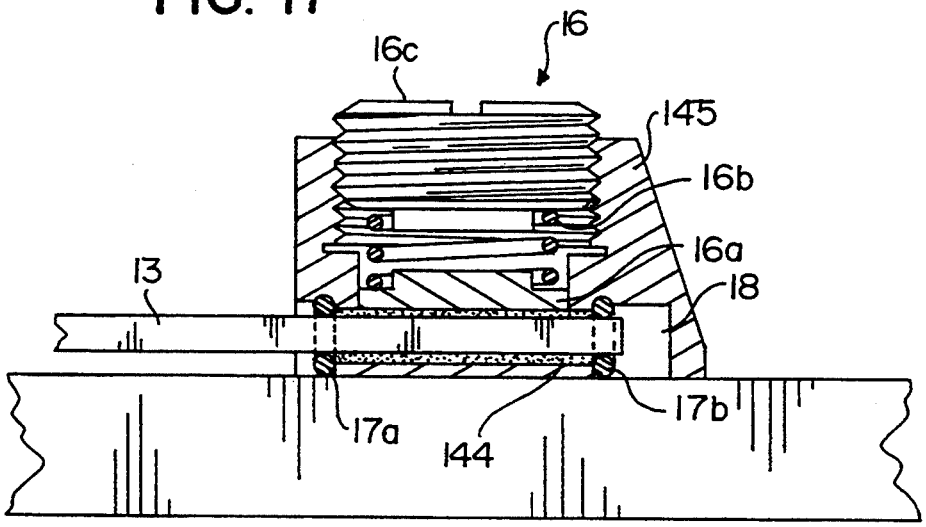
FIG. 17 is a partial side elevation view on a larger scale of the end of the shock absorption device at the level of the bush.

FIG. 17 illustrates a detailed example of a particular embodiment in which the flexion blade 13 slides in housing 144 of bush 145. The pressure exerted by the viscous film on the blade can be adjusted by virtue of the pressure element 16 comprising a plate 16*a* having a contact surface with the film, a helical spring 16*b* which acts directly on the plate by exerting a compression force and an adjustment screw 16*c*. By increasing the pressure exerted, the shock-absorption value of the ski is increased. Bush 145 is rendered impermeable between the blade and housing 144 by one or several O-ring seals 17*a*, 17*b* made of an elastomer or by a putty seal, for example. Naturally, the pressure element could also be made impermeable at the level of plate 16*a* by a seal preventing any departure of the viscous material from housing 144.

Figure 18:
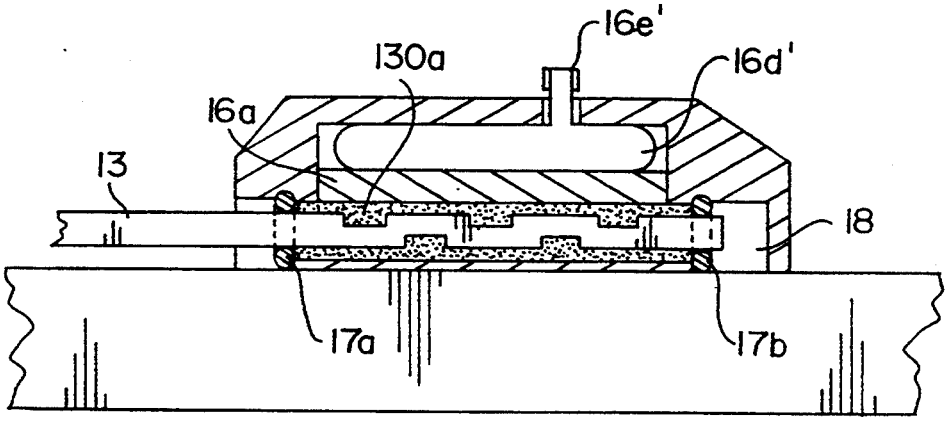
FIG. 18 is a view similar to FIG. 17, illustrating a variation.

FIG. 18 illustrates a second particular embodiment of the pressure element 16' which is of the pneumatic or hydraulic type. It comprises a plate 16'*a* cooperating with a bladder 16'*d* which can be inflated by means of a valve 16'*e*.

The blade comprises, on a part of its length at the level of housing 144, several stripes or channels 130*a* enabling the shearing phenomenon with the viscous material to be accentuated, and thus increasing the shock-absorption function of the system.

Figure 19:
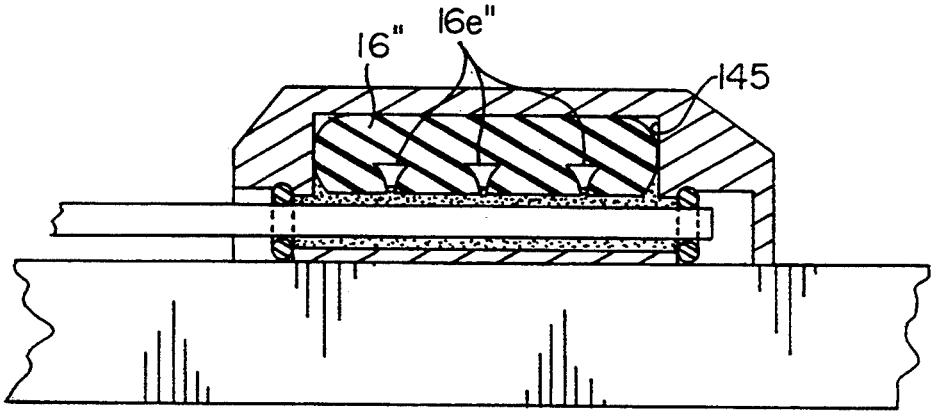
FIG. 19 is another variation of FIG. 17.

FIG. 19 illustrates another particular embodiment in which bush 145 comprises a pressure element 16'' constituted by a pre-stressed rubber part. This part comprises several transverse grooves 16''*e* along its length, enabling a homogeneous deformation of the part.

Figure 20:
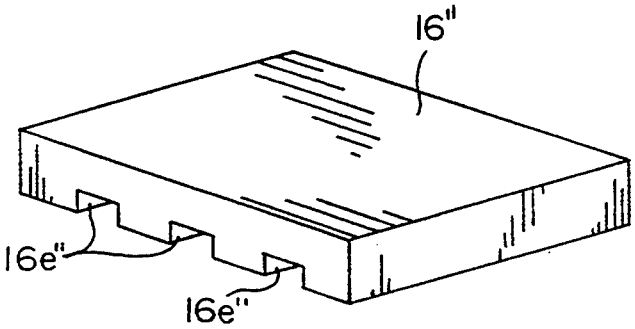
FIG. 20 is a perspective view of an element of the device of FIG. 19.

FIG. 20 illustrates the part before assembly without pre-stress.

In the two preceding embodiments, the bush 145 is a casing, closed at the end opposite to the introduction of the blade. A minimum space 18 can, however, be provided, enabling the displacement of the end of the blade without such blade coming into abutment against the wall of the casing.

The instant application is based upon French patent application 92.09734 of Jul. 31, 1992, the disclosure of which is hereby expressly incorporated by reference thereto, and the priority of which is hereby claimed.

Naturally, the invention is not limited to the embodiments described and represented in the examples hereinabove, but also comprises all technical equivalents and combinations thereof. For example, provision can be made to integrate the shock-absorption device into the structure of the ski itself.

What is claimed is:

1. A device for dampening vibration of a ski, comprising:

at least one longitudinally extending flexible blade having a first portion and a second portion;

at least one fixed connection device for affixing the first portion of the flexible blade against longitudinal movement with respect to the ski; and at least one dampening connection device to be affixed to the ski for allowing the second portion of said flexible blade to move longitudinally with respect to the ski upon ski flexion, said at least one dampening connection device comprising at least a layer of viscous material, whereby said second portion of said flexible blade comprises a surface in longitudinal sliding contact with said layer of viscous material of said dampening connection device to dampen vibrations of the ski during use of the ski.

2. A device according to claim 1, wherein:

said dampening connection device comprises at least one surface fixed with respect to said second portion of said flexible blade in longitudinal frictional sliding contact with a further surface fixed with respect to the ski; and said further surface comprises a surface of said layer of viscous material.

3. A device according to claim 1, wherein:

said first portion of said flexible blade is longitudinally spaced from said second portion at a predetermined distance.

4. A device according to claim 1, wherein:

said dampening connection device comprises bush to be affixed to the ski, said bush having a housing within which said flexible blade is slidingly positioned, said housing comprising said layer of viscous material.

5. A device according to claim 4, wherein:

said bush comprises a U-shaped stirrup having said housing, said housing being downwardly open.

6. A device according to claim 4, wherein:

said housing of said bush comprises a closed periphery defined by an upper wall, a lower wall and opposite lateral walls, said upper wall having a first side and a second side, said lower wall having a first side and a second side, said opposite lateral walls comprising a first lateral wall and a second lateral wall, said first lateral wall having an upper end and a lower end, said second lateral wall having an upper end and a lower end, said first side of said upper wall being connected to said upper end of said first lateral wall, said second side of said upper wall being connected to said upper end of said second lateral wall, said first side of said lower wall being connected to said lower end of said first lateral wall and said second side of said lower wall being connected to said lower end of said second lateral wall.

7. A device according to claim 1, wherein:

said viscous material of said dampening connection device has a viscosity between 20 and 1500 poise at 40° C.

8. A device according to claim 7, wherein:

said viscous material comprises a member selected from the group consisting of mineral grease, organic grease and putty.

9. A device according to claim 1, wherein:

said flexible blade comprises a member selected from the group consisting of an aluminum blade and a steel blade.

10. A device according to claim 9, wherein:

said flexible blade has a width of between 10 and 45 millimeters, a thickness of between 0.5 and 8 millimeters and a length of between 300 and 1800 millimeters.

11. A device according to claim 10, wherein:

said dampening connection device comprises a bush having a shock-absorption surface in contact with said flexible blade, said shock-absorption surface having an area greater than 170 millimeters$^2$.

12. A device according to claim 1, wherein:

said flexible blade comprises a blade made of a composite material.

13. A device according to claim 12, wherein:

said flexible blade has a width of between 10 and 45 millimeters, a thickness of between 0.5 and 8 millimeters and a length of between 300 and 1800 millimeters.

14. A device according to claim 13, wherein:

said dampening connection device comprises a bush having a shock-absorption surface in contact with said flexible blade, said shock-absorption surface having an area greater than 170 millimeters$^2$.

15. A device according to claim 1, wherein:

neither said flexible blade nor said dampening connection device comprise means for increasing static stiffness of the ski.

16. A device according to claim 28, wherein:

said at least a layer of viscous material comprises means for braking displacement of said second portion of said flexible blade with respect to the ski.

17. A device for dampening vibration of a ski, comprising:

at least one longitudinally extending flexible blade having a first portion and a second portion;

at least one fixed connection device for affixing the first portion of the flexible blade against longitudinal movement with respect to the ski; and at least one dampening connection device to be affixed to the ski for allowing the second portion of said flexible blade to move longitudinally with respect to the ski upon ski flexion, said at least one dampening connection device comprising at least a layer of viscous material, whereby said second portion of said flexible blade comprises a surface in a longitudinal sliding contact with said layer of viscous material of said dampening connection device during use of the ski, said dampening connection device comprising a member in contact with said layer of viscous material and a pneumatic, hydraulic or elastic pressure element in contact with said member for applying a viscous frictional force on said flexible blade to dampen vibrations of the ski.

18. A device according to claim 17, wherein:

said pressure element comprises means for adjusting said frictional force on said flexible blade.

19. A device according to claim 17 wherein:

neither said flexible blade nor said dampening connection device comprise means for increasing static stiffness of the ski.

20. A device according to claim 17, wherein:

said at least a layer of viscous material comprises means for braking displacement of said second portion of said flexible blade with respect to the ski.

21. An apparatus comprising:

a ski;

a device for dampening vibration of a ski, said device comprising:

at least one longitudinally extending flexible blade having a first portion and a second portion;

at least one fixed connection device affixing the first portion of the flexible blade against longitudinal movement with respect to the ski; and at least one dampening connection device to be affixed to the ski for allowing the second portion of said flexible blade to move longitudinally with respect to the ski upon ski flexion, said at least one dampening connection device comprising a layer of viscous material, whereby said second portion of said flexible blade comprises a surface in longitudinal sliding contact with said layer of viscous material of said dampening connection device to dampen vibrations of the ski during use of the ski.

22. An apparatus according to claim 21, wherein:

said dampening connection device comprises at least one surface fixed with respect to said second portion of said flexible blade in longitudinal frictional sliding contact with a further surface fixed with respect to the ski; and said further surface comprises a surface of said layer of viscous material.

23. An apparatus according to claim 21, wherein: said first portion of said flexible blade is longitudinally spaced from said second portion at a predetermined distance.

24. An apparatus according to claim 21, wherein:

said dampening connection device comprises a bush to be affixed to the ski, said bush having a housing within which said flexible blade is slidingly positioned, said housing comprising said layer of viscous material.

25. An apparatus according to claim 24, wherein:

said bush comprises a U-shaped stirrup having said housing, said housing being downwardly open.

26. A device according to claim 24, wherein:

said housing of said bush comprises a closed periphery defined by an upper wall, a lower wall and opposite lateral walls, said upper wall having a first side and a second side, said lower wall having a first side and a second side, said opposite lateral walls comprising a first lateral wall and a second lateral wall, said first lateral wall having an upper end and a lower end, said second lateral wall having an upper end and a lower end, said first side of said upper wall being connected to said upper end of said first lateral wall, said second side of said upper wall being connected to said upper end of said second lateral wall, said first side of said lower wall being connected to said lower end of said first lateral wall and said side of said lower wall being connected to said lower end of second lateral wall.

27. A device according to claim 21, wherein:

said viscous material of said dampening connection device has a viscosity between 20 and 1500 poise at 40° C.

28. An apparatus according to claim 27, wherein:

said viscous material comprises a member selected from the group consisting of mineral grease, organic grease and putty.

29. An apparatus according to claim 21, wherein:

said flexible blade comprises a member selected from the group consisting of an aluminum blade and a steel blade.

30. An apparatus according to claim 29, wherein:

said flexible blade has a width of between 10 and 45 millimeters, a thickness of between 0.5 and 8 millimeters and a length of between 300 and 1800 millimeters.

31. An apparatus according to claim 30, wherein:

said dampening connection device comprises a bush having a shock-absorption surface in contact with said flexible blade, said shock-absorption surface having an area greater than 170 millimeters$^2$.

32. An apparatus according to claim 21, wherein:

said flexible comprises a blade made of a composite material.

33. An apparatus according to claim 32, wherein:

said flexible blade has a width of between 10 and 45 millimeters, a thickness of between 0.5 and 8 millimeters and a length of between 300 and 1800 millimeters.

34. An apparatus according to claim 33, wherein:

said dampening connection device comprises a bush having a shock-absorption surface in contact with said flexible blade, said shock-absorption surface having an area greater than 170 millimeters$^2$.

35. An apparatus according to claim 21, wherein:

said flexible blade is positioned and attached to an upper surface of said ski.

36. An apparatus according to claim 21, wherein:

said flexible blade is located within said ski.

37. An apparatus according to claim 21, wherein:

said ski comprises a front contact line and a central binding assembly zone; and said flexible blade extends forwardly to a position between said front contact line and said central binding assembly zone.

38. An apparatus according to claim 37, wherein:

said fixed connection device is fixed to said ski forwardly of said dampening connection device, said first portion of said flexible blade comprising a forward portion of said flexible blade fixed to said ski by said fixed connection device; and said dampening connection device comprises a bush affixed to said ski, said bush comprising a viscous material, said second portion of said flexible blade comprising a rearward portion of said flexible blade slidingly positioned within said bush.

39. An apparatus according to claim 38, wherein:

said bush is affixed to said ski forwardly of said central binding assembly zone.

40. An apparatus according to claim 38, wherein:

said bush is affixed to said ski along the entirety of said central binding assembly zone, said bush comprising means for supporting ski boot bindings.

41. An apparatus according to claim 21, wherein:

said ski comprises a central binding assembly zone; and said flexible blade extends rearwardly to said central binding assembly zone.

42. An apparatus according to claim 21, wherein:

said ski comprises a rear contact line and a central binding assembly zone; and said flexible blade extends rearwardly to a position between said rear contact line and said central binding assembly zone.

43. An apparatus according to claim 42, wherein:

said fixed connection device is fixed to said ski rearwardly of said dampening connection device, said first portion of said flexible blade comprising a rearward portion of said flexible blade fixed to said ski by said fixed connection device; and said dampening connection device comprises a bush affixed to said ski, said bush comprising a viscous material, said second portion of said flexible blade comprising a forward portion of said flexible blade slidingly positioned within said bush.

44. An apparatus according to claim 43, wherein:

said bush is affixed to said ski rearwardly of said central binding assembly zone.

45. An apparatus according to claim 43, wherein:

said bush is affixed to said ski along the entirety of said central binding assembly zone, said bush comprising means for supporting ski boot bindings.

46. An apparatus according to claim 21, wherein:

said ski comprises a central binding assembly zone; and said flexible blade extends forwardly to said central binding assembly zone.

47. A device according to claim 21, wherein:

said ski comprises a predetermined static stiffness; and neither said flexible blade nor said dampening connection device comprise means for generating additional static stiffness of the ski.

48. A device according to claim 21, wherein:

said at least a layer of viscous material comprises means for braking displacement of said second portion of said flexible blade with respect to the ski.

49. An apparatus comprising:

a ski;

a device for dampening vibration of a ski, said device comprising:

at least one longitudinally extending flexible blade having a first portion and a second portion;

at least one fixed connection device affixing the first portion of the flexible blade against longitudinal movement with respect to the ski; and at least one dampening connection device to be affixed to the ski for allowing the second portion of said flexible blade to move longitudinally with respect to the ski upon ski flexion, said at least one dampening connection device comprising a layer of viscous material, whereby said second portion of said flexible blade comprises a surface in longitudinal sliding contact with said layer of viscous material of said dampening connection device to dampen vibrations of the ski during use of the ski, wherein said dampening connection device comprises a member in contact with said layer of viscous material and a pneumatic, hydraulic or elastic pressure element in contact with said member for applying a viscous frictional force on said flexible blade.

50. An apparatus according to claim 49, wherein:

said pressure element comprises means for adjusting said frictional force on said flexible blade.

* * * * *